US010895014B2

(12) United States Patent
Nagaike

(10) Patent No.: US 10,895,014 B2
(45) Date of Patent: Jan. 19, 2021

(54) PROCESSING METHOD AND PROCESSING APPARATUS OF METAL MEMBER

(71) Applicant: Tokyo Electron Limited, Tokyo (JP)

(72) Inventor: Hiroshi Nagaike, Miyagi (JP)

(73) Assignee: Tokyo Electron Limited, Tokyo (JP)

( * ) Notice: Subject to any disclaimer, the term of this patent is extended or adjusted under 35 U.S.C. 154(b) by 44 days.

(21) Appl. No.: 16/287,273

(22) Filed: Feb. 27, 2019

(65) Prior Publication Data

US 2019/0271085 A1 Sep. 5, 2019

(30) Foreign Application Priority Data

Mar. 2, 2018 (JP) ..... 2018-038041

(51) Int. Cl.
*C23C 22/82* (2006.01)
*C23C 22/06* (2006.01)

(52) U.S. Cl.
CPC ..... *C23C 22/82* (2013.01); *C23C 22/06* (2013.01)

(58) Field of Classification Search
CPC ..... C23C 22/82; C23C 22/06; F26B 21/00; F26B 21/06; F26B 9/00
USPC ..... 34/446
See application file for complete search history.

(56) References Cited

U.S. PATENT DOCUMENTS 4,888,203 A * 12/1989 Rothschild ..... C04B 41/009 427/584
5,224,998 A * 7/1993 Ohmi ..... C23C 8/10 118/720
5,401,677 A * 3/1995 Bailey ..... C23C 14/165 257/E21.165
5,861,328 A * 1/1999 Tehrani ..... H01L 27/0688 257/E27.026
6,635,569 B1 * 10/2003 Ameen ..... C23C 16/14 438/680
7,314,785 B2 * 1/2008 Yamazaki ..... H01L 27/1214 438/149
9,768,322 B2 * 9/2017 Yu ..... H01L 21/82341
2002/0062858 A1 * 5/2002 Mowles ..... H01L 31/02168 136/252
2003/0183306 A1 * 10/2003 Hehmann ..... C23C 14/22 148/404
2016/0340787 A1 * 11/2016 Sambasivan ..... C23C 22/83
2017/0051413 A1 * 2/2017 Marmann ..... C25D 5/48
2017/0292193 A1 * 10/2017 Jaworowski ..... C23C 22/78
2019/0203360 A1 * 7/2019 Pfirrmann ..... C23C 22/68
2019/0271085 A1 * 9/2019 Nagaike ..... C21D 1/76

FOREIGN PATENT DOCUMENTS

JP H07-233476 9/1995
JP 2006-322540 11/2006
JP 2019151892 A * 9/2019 ..... C21D 3/02

OTHER PUBLICATIONS

Tadahiro Ohmi et al., The Technology of Chromium Oxide Passivation on Stainless Steel Surface, J. Electrochem. Soc., Jun. 1993, vol. 140, No. 6, pp. 1691-1699.

* cited by examiner

*Primary Examiner* — Stephen M Gravini
(74) *Attorney, Agent, or Firm* — IPUSA, PLLC

(57) ABSTRACT

A method of processing a metal member having a passivation film on its surface is provided. The method includes a step of heating the metal member for a predetermined period at a temperature of 300° C. or higher.

13 Claims, 12 Drawing Sheets

PROCESSING METHOD AND PROCESSING APPARATUS OF METAL MEMBER

CROSS-REFERENCE TO RELATED APPLICATIONS

This patent application is based on and claims priority to Japanese Patent Application No. 2018-038041 filed on Mar. 2, 2018, the entire contents of which are incorporated herein by reference.

BACKGROUND OF THE INVENTION

1. Field of the Invention

The present invention generally relates to a processing method, a processing apparatus, and an evaluation method of a metal member.

2. Description of the Related Art

In a processing apparatus using corrosive gas such as $Cl_2$, stainless steel (hereinafter referred to as "SUS") used for the processing apparatus may be corroded because gas in the processing apparatus reacts with moisture introduced into the processing apparatus from outside. To avoid corrosion, for example, Patent Document 1 proposes a method of forming a passivation film having corrosion resistance to corrosive gas on an uppermost surface of stainless steel. Patent Document 1 also discloses a process for removing moisture from a surface of stainless steel by applying a bake-out process in an inert gas, before forming a passivation film on an uppermost surface of stainless steel.

Further, Patent Document 2 discloses a method of manufacturing a gas pipe in which a bake-out process is applied to the gas pipe at a temperature of 120° C. to 150° C.

However, after a bake-out process is applied to stainless steel, a hydrate may be generated by adhesion of moisture to passivation film. Because of the hydrate, stainless steel may be corroded and metallic contamination by Cr, Fe, Ni, or the like, or particle may be generated.

In one aspect, the present disclosure aims at suppressing corrosion of metal members.

CITATION LIST

[Patent Document]

[Patent Document 1] Japanese Laid-open Patent Application Publication No. 07-233476

[Patent Document 2] Japanese Laid-open Patent Application Publication No. 2006-322540

Non-Patent Document

[Non-Patent Document 1] Ohmi et al., "The Technology of Chromium Oxide Passivation on Stainless Steel Surface", J. Electrochem. Soc., Vol. 140, No. 6, pages 1691 to 1699, June 1993

SUMMARY OF THE INVENTION

According to an aspect of the present invention, a method of processing a metal member having passivation film on its surface is provided. The method includes a step of heating the metal member for a predetermined period at a temperature of 300° C. or higher.

DETAILED DESCRIPTION OF EMBODIMENTS

In the following, embodiments of the present disclosure will be described with reference to the drawings. Note that in the following descriptions and the drawings, elements having substantially identical features are given the same reference symbols and overlapping descriptions may be omitted.

[Substrate Processing Apparatus]

Figure 1:
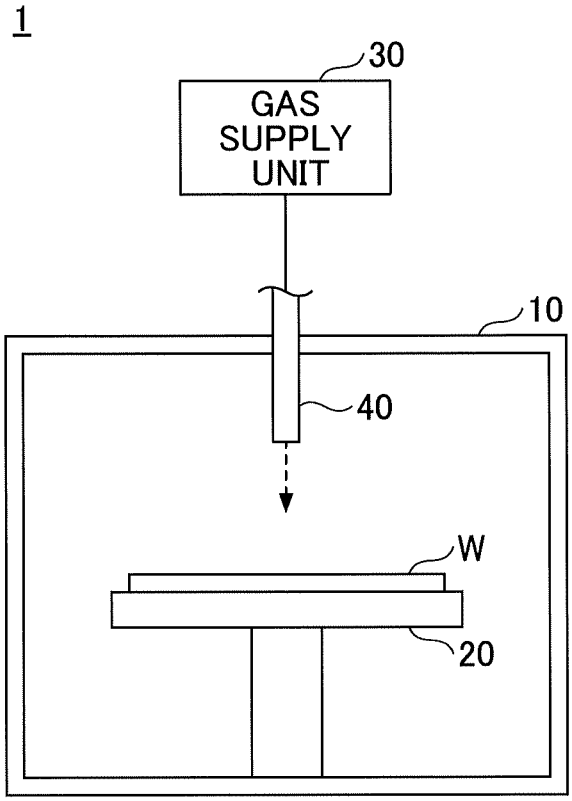
FIG. 1 is a diagram illustrating an example of a substrate processing apparatus according to an embodiment.

First, an example of a substrate processing apparatus 1 according to an embodiment will be described with reference to FIG. 1. FIG. 1 is a diagram illustrating a configuration of the substrate processing apparatus 1 according to the present embodiment. In the substrate processing apparatus 1 according to the present embodiment, an SUS pipe 40 is used for supplying gas.

The substrate processing apparatus 1 according to the present embodiment includes, in a processing vessel 10, a stage 20 used for placing a wafer W. From a gas supply unit 30, corrosive gas such as $CF_4$ gas or inert gas such as Ar gas is provided. Gas supplied from the gas supply unit 30 is introduced in the processing vessel 10, and a predetermined process is applied to the wafer W with the supplied gas. Though not illustrated, an opening for loading and/or unloading the wafer W is provided at a side wall of the processing vessel 10, and the opening is opened and/or closed with a gate valve.

The SUS pipe 40 is an example of a stainless steel part. The stainless steel part is not limited to a pipe, but may be various types of parts such as a joint, a valve, and a screw, which can be used in an apparatus such as the substrate processing apparatus 1. Stainless steel to be processed by the present invention can also be used for parts in an apparatus to which corrosive gas is introduced. An apparatus, in which the stainless steel to be processed by the present invention is used, is not limited to the substrate processing apparatus 1. The stainless steel to be processed by the present invention is applicable to various types of apparatuses such as an etching apparatus, a film forming apparatus, and a cleaning apparatus, which use corrosive gas.

Figure 2A:
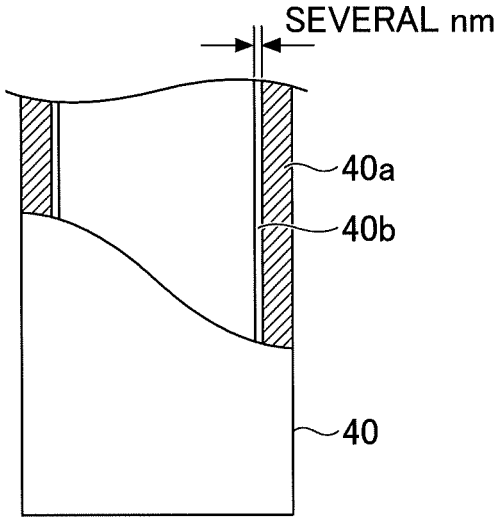
FIG. 2A and FIG. 2B are enlarged views of a pipe according to the embodiment.
Figure 2B:
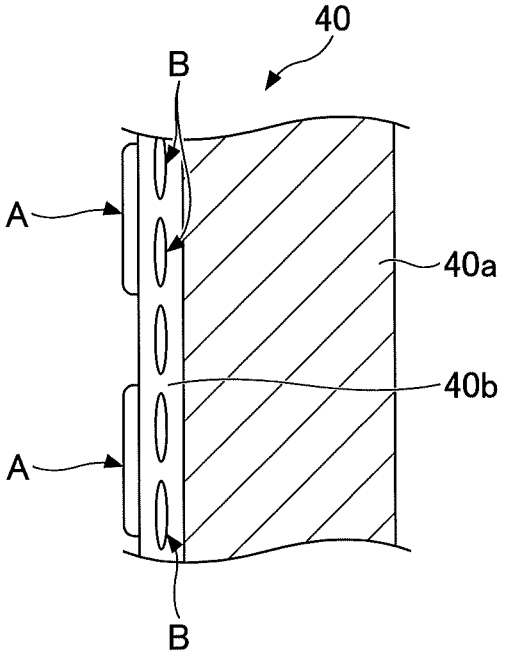

FIG. 2A and FIG. 2B are enlarged views of the SUS pipe 40 according to the present embodiment. As illustrated in FIG. 2A, a main part 40*a* of the SUS pipe 40 is made from Fe. On a surface of the main part 40*a*, chromium passivation film ($Cr_2O_3.(H_2O)_x$) 40*b* having a thickness of several nanometers is formed (hereinafter, the chromium passivation film 40*b* may also be referred to as "Cr passivation film 40*b*"). By an electropolishing process (EP process) being applied to the SUS pipe 40, the Cr passivation film 40*b* is formed, and moisture gets contained in the Cr passivation film 40*b* during the EP process.

The main part 40*a* of Fe is weaker to corrosion than the Cr passivation film 40*b*. Thus, damage or abrasion of the Cr passivation film 40*b* having several nanometers thickness leads to corrosion of Fe. Therefore, in order to avoid or reduce corrosion of Fe, reducing damage or abrasion of the Cr passivation film 40*b* is necessary.

A model of corrosion of stainless steel such as the SUS pipe 40 is represented as the following chemical equations, for example.

$$Cr_2O_3+Cl_2+H_2O \rightarrow Cr_2O_3+HCl \rightarrow CrCl_3+O_2+H_2O$$
$$CrCl_3 \rightarrow CrCl_3\uparrow$$

As can be seen from the above chemical equations, the Cr passivation film 40*b* does not cause a chemical reaction by contact with only $Cl_2$ gas. By intervention of "water" (moisture), hydrochloric acid is generated, and as the Cr passivation film 40*b* reacts with the hydrochloric acid, gas such as $CrCl_3$ is generated.

As described above, the Cr passivation film 40*b* formed on a surface of the SUS pipe 40 is changed into Cr or gas such as $CrCl_3$ by reacting with corrosive gas and water, and as a result, the Cr passivation film 40*b* emits Cr, $CrCl_3$ gas, and the like. Because the emitted $CrCl_3$ gas adheres to a wafer W and causes Cr contamination, it affects adversely a process of the wafer W. Further, by the Cr passivation film 40*b* being damaged, the main part 40*a* of Fe is exposed at a surface of the SUS pipe 40. As the exposed Fe reacts with $Cl_2$ gas, the SUS pipe 40 is further corroded. As the corrosion proceeds, metallic contamination by Cr, Fe, Ni, or the like, or particle contamination occurs.

One conceivable countermeasure for avoiding corrosion is to coat a surface of stainless steel with corrosion resistant material such as Hastelloy (registered trademark) or to coat with Y-based film or $SiO_2$-based film. However, this countermeasure is costly. Further, because shapes of stainless steel capable of being coated are limited, this countermeasure cannot be applied to stainless steel having complex shapes.

Another conceivable countermeasure is to promote desorption of moisture from stainless steel by heating at a temperature of 60° C. to 80° C. However, it is known that a half-hearted heating accelerates corrosion. Thus, this countermeasure is insufficient or unsuitable for countermeasure of corrosion.

Therefore, in order to protect the Cr passivation film 40*b* and suppress corrosion of the SUS pipe 40, it is necessary to control (eliminate) moisture in the SUS pipe 40.

As illustrated in FIG. 2B, which is an enlarged view of the Cr passivation film 40*b*, two types of moisture can be observed. The first type of moisture (A) adheres to the surface of the SUS pipe 40 physically, and the second type of moisture (B) is chemically adsorbed in the Cr passivation film 40*b* as a hydrate or the like. Hereinafter, moisture that physically adheres to the surface of the SUS pipe 40 will be referred to as "physically adsorbed moisture", and moisture that is contained in the Cr passivation film 40*b* as a hydrate or the like will be referred to as "chemically adsorbed moisture". Physically adsorbed moisture is desorbed by means of evacuation, $N_2$ purge, or the like, and can be removed at a temperature lower than 150° C. to 160° C. Conversely, it is difficult to remove chemically adsorbed moisture. Chemically adsorbed moisture can be removed at a temperature of 300° C. In the following, a result of an experiment of desorbing moisture from the SUS pipe 40 will be described. In the experiment, variation of concentration of moisture desorbed from the SUS pipe 40 has been observed.

[Experiment 1: Monitoring Moisture Concentration]

In order to analyze how the above mentioned two types of moisture, physically adsorbed moisture and chemically adsorbed moisture, affect corrosion of the SUS pipe 40, an experiment (hereinafter referred to as "experiment 1") of monitoring moisture concentration desorbed from the SUS pipe 40 has been performed, by controlling temperature of the SUS pipe 40. A configuration of a system used in the experiment 1 is illustrated in FIG. 3.

Figure 3:
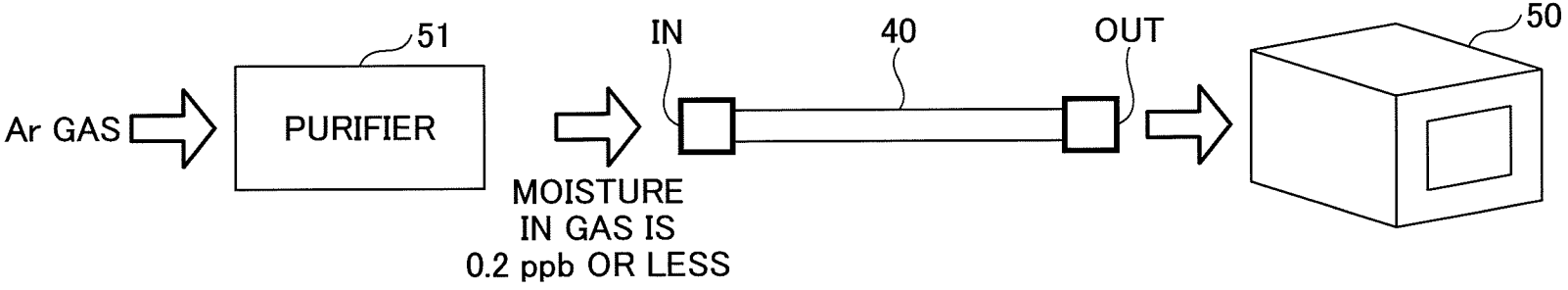
FIG. 3 is a diagram illustrating an example of a system used for an experiment for monitoring moisture desorbed from the pipe according to the embodiment.

In the experiment 1 using the system of FIG. 3, the following procedures were performed. First, moisture in Ar gas that was supplied from a factory was trapped by a purifier 51, to cause moisture concentration in the Ar gas to be 0.2 ppb (parts per billion) or less. Next, the Ar gas having moisture concentration of 0.2 ppb or less was flushed through an inside of the SUS pipe 40 from a gas inlet (IN). At a downstream side of the SUS pipe 40, a moisture detecting device 50, such as a CRDS (Cavity Ring Down Spectroscopy) type moisture meter, was provided. The moisture detecting device 50 monitored moisture concentration in the Ar gas flowing out of a gas outlet (OUT) of the SUS pipe 40.

Figure 4:
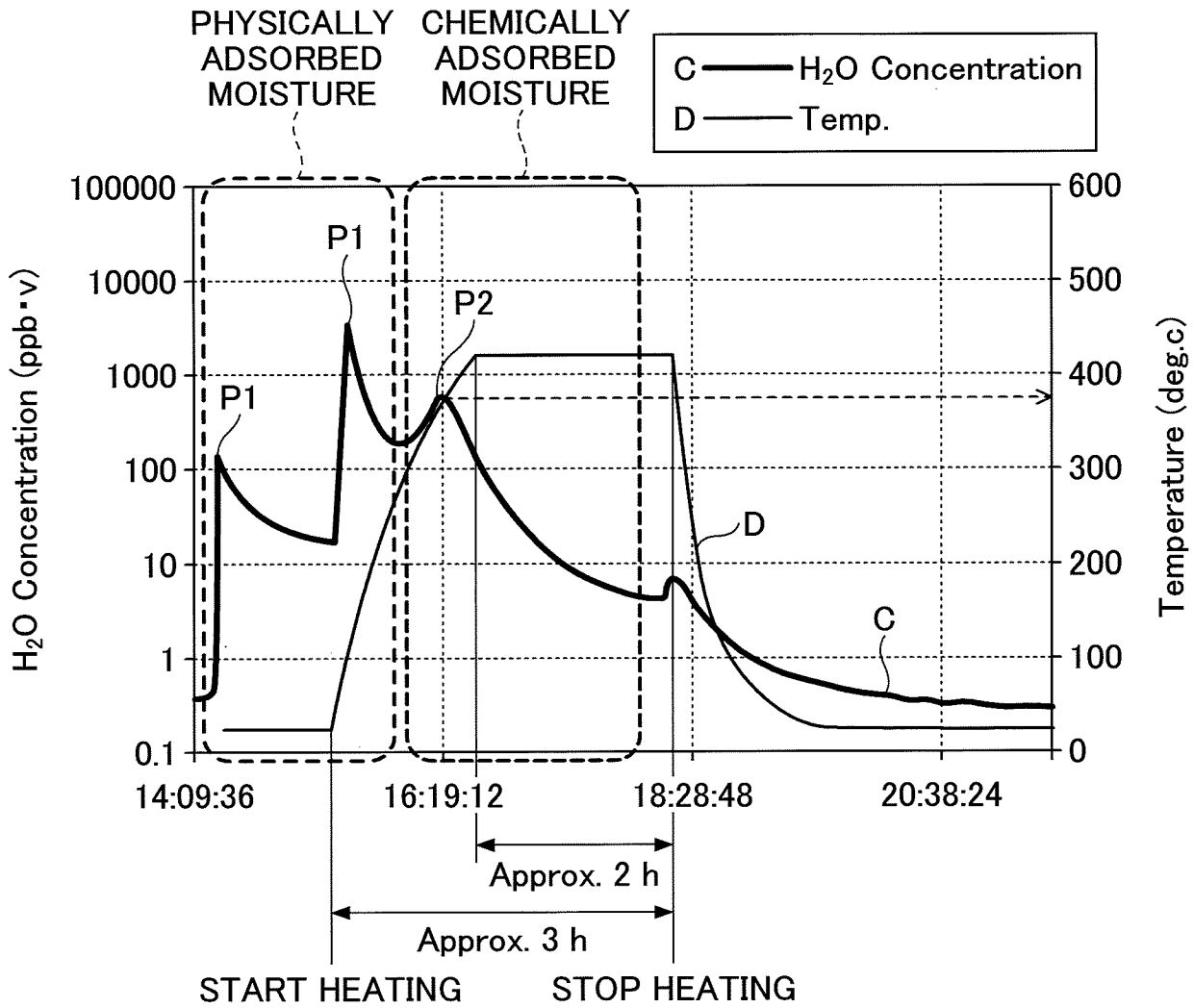
FIG. 4 is a graph illustrating a result of the monitoring of the moisture desorbed from the pipe according to the embodiment.

A graph in FIG. 4 illustrates a result of the monitoring of moisture concentration of the Ar gas flowing out of the gas outlet (OUT), by controlling temperature of the SUS pipe 40. A horizontal axis in FIG. 4 represents a time (the time axis in the graph also includes a time before heating and a time after the heating), a right vertical axis represents temperature of the SUS pipe 40, and a left vertical axis represents concentration of moisture desorbed from the SUS pipe 40.

A curve C represents moisture concentration monitored by the moisture detecting device 50 (that is, an example of the result of the experiment of concentration of moisture desorbed from the SUS pipe 40). A curve D represents a heating temperature of the SUS pipe 40. Before heating was started, Ar gas was flushed through the inside of the SUS pipe 40 at a normal temperature (25° C.). When the heating was started, temperature of the SUS pipe 40 started rising. After the temperature of the SUS pipe 40 reached approximately 400° C., the temperature of the SUS pipe 40 was retained to approximately 400° C. After the heating was terminated, the temperature of the SUS pipe 40 decreased.

In the curve C of FIG. 4, two types of peaks (first peaks P1 and a second peak P2) can be observed (Note that two of the P1 are present in the curve C. In the following description, the P1 at a left side is referred to as a left peak P1, and the P1 at a right side is referred to as a right peak P1). By only Ar gas being flushed through the SUS pipe 40 before heating the SUS pipe 40, the left peak P1 caused by desorbed moisture was observed. Also, after the heating of the SUS pipe 40 was started and when the temperature of the SUS pipe 40 reached approximately 100° C. to 150° C., the right peak P1 caused by desorbed moisture was observed. As these two peaks P1 appear at points in which temperature of the SUS pipe 40 is 150° C. or lower, the peaks P1 are considered to be caused by desorption of physically adsorbed moisture on the SUS pipe 40.

Conversely, desorption of chemically adsorbed moisture starts at a temperature of 300° C. or higher, and an amount of the desorbed moisture increases until temperature reaches approximately 380° C. It was observed that the peak P2 occurs when the SUS pipe 40 was heated to 380° C. and an amount of the desorbed moisture decreased after the temperature of the SUS pipe 40 became 380° C. or higher.

It is considered that moisture desorbed from the SUS pipe 40 at a temperature of 300° C. or higher is mainly chemically adsorbed moisture desorbed from the Cr passivation film 40*b*. Accordingly, in order to desorb chemically adsorbed moisture from the SUS pipe 40, it is effective to heat the SUS pipe 40 for a certain period of time at a temperature of 300° C. or higher. Also, it is more effective that the SUS pipe 40 is heated to not lower than approximately 320° C. or 325° C., because desorbed moisture increases. Further, if the SUS pipe 40 is heated to 380° C. or higher, as the peak P2 of concentration of desorbed moisture occurs, it is considered that moisture can be removed almost perfectly from the SUS pipe 40.

Note that the SUS pipe 40 may be heated to 400° C. or higher. However, by considering effect given to a joint and the like which are used with the SUS pipe 40, it is preferable that the SUS pipe 40 is heated to 450° C. or lower.

In the example of FIG. 4, the SUS pipe 40 was heated for approximately 2 hours after the temperature of the SUS pipe 40 reached approximately 400° C. Also, a heating time of the SUS pipe 40 from a start to end of heating was approximately 3 hours. However, a time for heating the SUS pipe 40 is not limited to the above example. For example, if initial states of the SUS pipes 40, flow rate of inert gas, and heating rate are not stable, a heating time may be changed in real time by monitoring concentration of moisture desorbed from the SUS pipe 40, with the moisture detecting device 50.

It has not been known so far which type of moisture contributes to corrosion of the SUS pipe 40. Also, it has not been known so far to what extent moisture should be removed from the SUS pipe 40 in order to suppress corrosion of the SUS pipe 40. However, according to the above described result of the experiment, a temperature required for removing physically adsorbed moisture adhering to the SUS pipe 40, and a temperature required for removing chemically adsorbed moisture in the Cr passivation film 40*b* have been identified.

That is, by heating the SUS pipe 40 for a certain period of time at a temperature of 300° C. or higher, chemically adsorbed moisture in the Cr passivation film 40*b* formed on an innermost surface of the SUS pipe 40 can be removed.

[Experiment 2: Analysis of Moisture Concentration and Degree of Corrosion]

Figure 5:
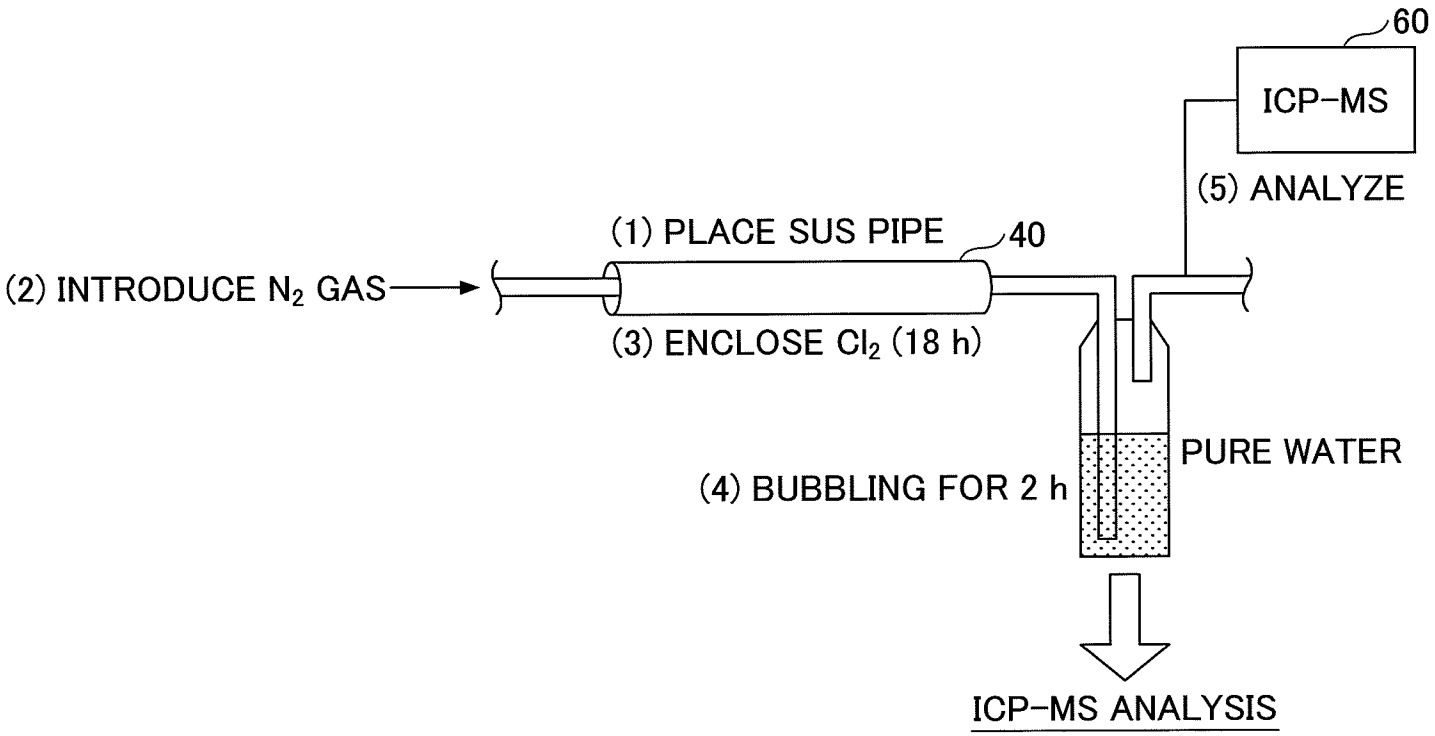
FIG. 5 is a diagram illustrating an example of a system used for an experiment for evaluating a relationship between moisture amount in the pipe according to the embodiment and a degree of corrosion.
Figure 6:
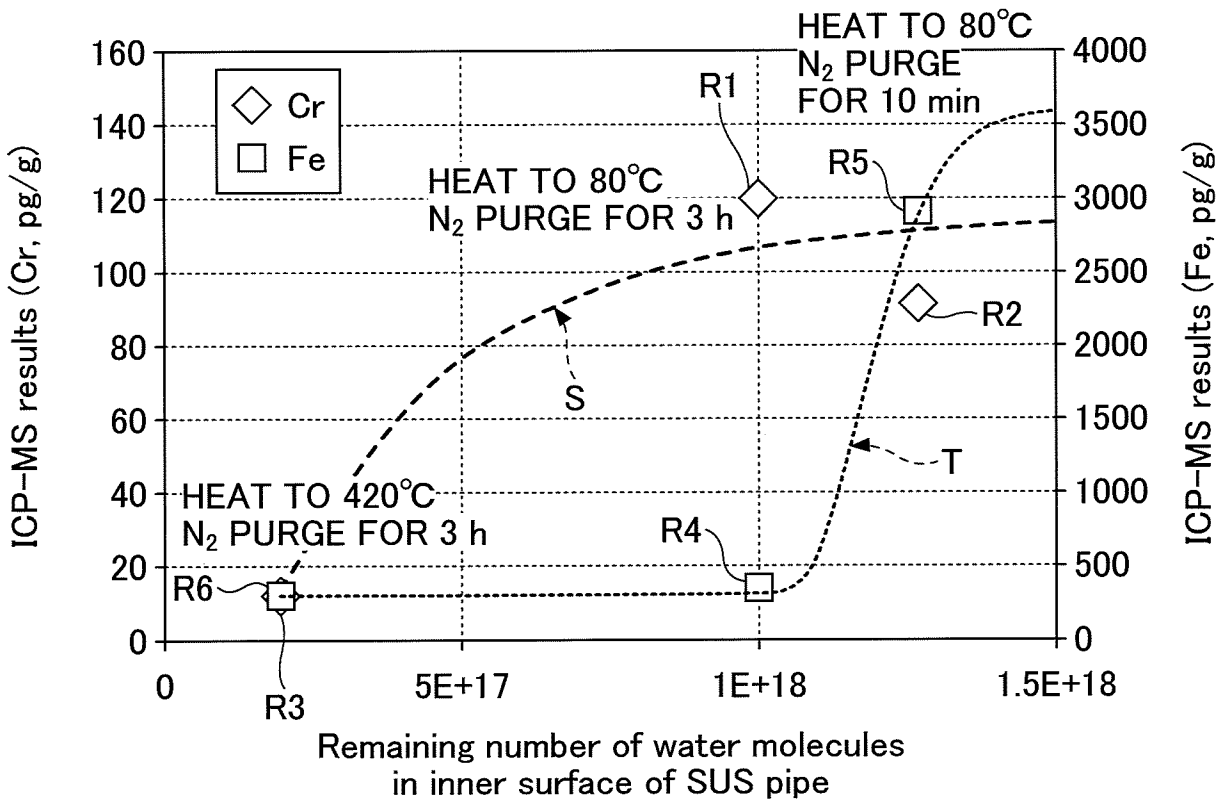
FIG. 6 is a graph illustrating a result of the evaluation of the relationship between the moisture concentration and the degrees of corrosion.

Next, an experiment (hereinafter referred to as "experiment 2") of evaluating a degree of corrosion of the SUS pipe 40 exposed to $Cl_2$ gas has been performed, by changing an amount of moisture on a surface of the SUS pipe 40. An evaluation method and a result of the experiment 2 will be described with reference to FIGS. 5 and 6. FIG. 5 is a diagram illustrating an example of a system used for the experiment 2 for evaluating a relationship between moisture amount in the SUS pipe 40 according to the embodiment and degrees of corrosion. FIG. 6 is a graph illustrating an example of an evaluation result of the relationship between the moisture amount in the SUS pipe 40 according to the embodiment and degrees of corrosion.

The evaluation method used in the experiment 2 will be described with reference to FIG. 5 illustrating the system used for the experiment 2.

(Evaluation Method)

(1) First, the SUS pipe 40 was placed at a given location of an atmospheric environment.

(2) $N_2$ gas was flushed through the inside of the SUS pipe 40 (this operation may also be referred to as "purge" in the present embodiment), in order to reduce moisture inside the SUS pipe 40. In the experiment 2, purging for 10 minutes was performed and purging for 3 hours was performed.

(3) $Cl_2$ gas was enclosed in the SUS pipe 40. In the experiment 2, $Cl_2$ gas had been enclosed for 18 hours.

(4) After 18 hours had been passed, $N_2$ gas was again flushed through the SUS pipe 40, and the gas having been flushed through the SUS pipe 40 was introduced into pure water for bubbling. The bubbling was performed for 2 hours in the experiment 2. After the bubbling, part of the pure water was sampled.

(5) The sampled pure water was analyzed by inductively coupled plasma-mass spectrometry (ICP-MS), using an ICP-MS analysis device 60.

FIG. 6 illustrates examples of results of analysis, which were obtained by applying the above mentioned evaluation method to the SUS pipe 40 heated to 80° C. and to the SUS pipe 40 heated to 420° C. A horizontal axis in FIG. 6 represents moisture amount remained inside the SUS pipe 40. The moisture amount is expressed as the number of molecules. A left vertical axis in FIG. 6 represents an amount of Cr (a unit of the amount is pg) dissolved in the sampled pure water of 1 gram (which was obtained as a result of ICP-MS). A right vertical axis represents an amount of Fe (a unit of the amount is pg) dissolved in the sampled pure water of 1 gram (which was obtained as a result of ICP-MS).

Points R1, R2, R4, and R5 in FIG. 6 represent the analysis results with respect to the SUS pipe 40 having been heated at 80° C. in order to reduce moisture (at (2) in the above evaluation method). R1 and R4 respectively represent amounts of Cr and Fe which were dissolved in the pure water obtained by applying the above procedures (3) to (5) to the SUS pipe 40 having been heated at 80° C. and purged for 3 hours. R2 and R5 respectively represent amounts of Cr and Fe which were dissolved in the pure water obtained by applying the above procedures (3) to (5) to the SUS pipe 40 having been heated at 80° C. and purged for 10 minutes. The above result of FIG. 6 means that, if $Cl_2$ gas is enclosed for 18 hours in the SUS pipe 40 from which moisture has been reduced by heating at 80° C., the inside of the SUS pipe 40 corrodes and a large amount of Cr and Fe are detected. Also, even if a time for purging of the SUS pipe 40 is increased from 10 minutes to 3 hours, a detected amount of Fe is decreased but a large amount of Cr is detected. Thus, it is found that the Cr passivation film 40*b* has been damaged or abraded.

Conversely, with respect to the SUS pipe 40 having been heated at 420° C. and purged for 3 hours, when gas was flushed through the SUS pipe 40 and bubbling was performed, little Cr and Fe were detected as a result of analysis by the ICP-MS analysis device 60, as illustrated in FIG. 6. That is, in order to suppress corrosion of the inside of the SUS pipe 40 caused by $Cl_2$ gas, heating the SUS pipe 40 at 300° C. to 420° C. is preferable.

A curve S in FIG. 6 represents a tendency of a detected amount of Cr. A curve T in FIG. 6 represents a tendency of a detected amount of Fe. According to the result in FIG. 6, Cr is more likely to be detected than Fe even if a remaining amount of moisture in the SUS pipe 40 is not large. Although the main part 40*a* of the SUS pipe 40 is made from Fe, as the Cr passivation film 40*b* is formed on an innermost surface of the SUS pipe 40, Cr is first removed from the Cr passivation film 40*b* which is formed on an innermost surface of the SUS pipe 40, when corrosion occurs. This is a reason that Cr is more likely to be detected than Fe. Thus, Cr is detected earlier than Fe, and as corrosion caused by $Cl_2$ gas proceeds, Fe is also detected.

The experimental result in FIG. 6 represents the following fact. Even if the SUS pipe 40 is heated at 80° C. and purging by using $N_2$ gas is performed for 3 hours, although physically adsorbed moisture may be removed, chemically adsorbed moisture cannot be removed and a detected amount of Cr will not decrease. Thus, corrosion occurring in an internal surface of the SUS pipe 40 cannot be suppressed. In order to avoid corrosion by removal of moisture, chemically adsorbed moisture such as a hydrate which is in the Cr passivation film 40*b* on the surface of the SUS pipe 40 must be removed.

That is, in order to suppress corrosion of the SUS pipe 40, it is effective to desorb not only physically adsorbed moisture adhering to a surface of the SUS pipe 40 but also chemically adsorbed moisture in the Cr passivation film 40*b*. By desorbing chemically adsorbed moisture in the Cr passivation film 40*b* in addition to physically adsorbed moisture adhering to a surface of the SUS pipe 40, a remaining amount of moisture in the SUS pipe 40 can be decreased, damage or abrasion of the Cr passivation film 40*b* is suppressed, and amount of Fe contamination can be suppressed, as well as amount of Cr contamination.

[Processing Method of SUS Pipe]

Figure 7:
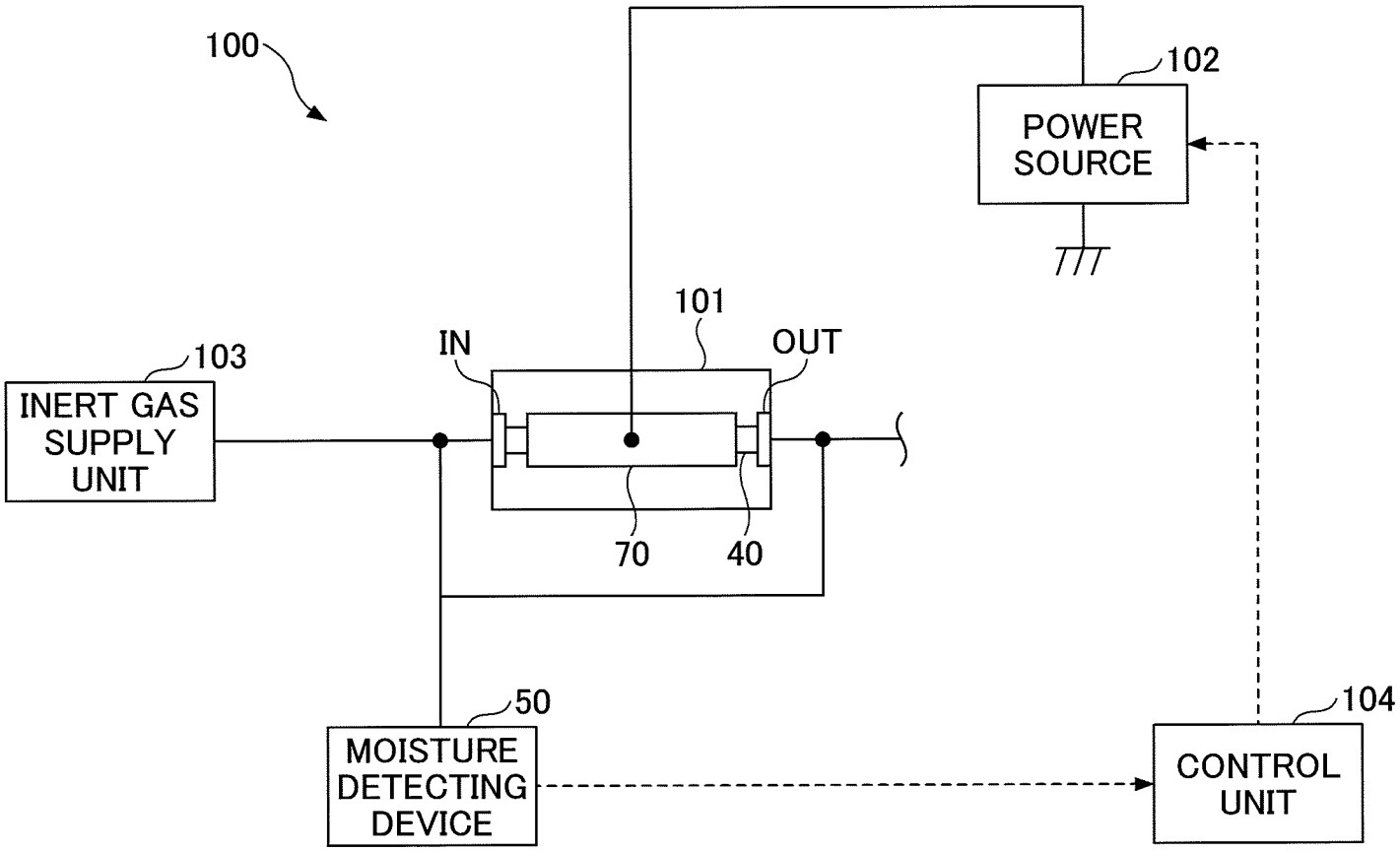
FIG. 7 is a diagram illustrating an example of a processing apparatus according to the embodiment.

In the following, a processing method of the SUS pipe 40 and a processing apparatus for the SUS pipe 40, which are used for desorbing not only physically adsorbed moisture adhering to a surface of the SUS pipe 40 but also chemically adsorbed moisture in the Cr passivation film 40*b*, will be described. FIG. 7 is a diagram illustrating an example of a processing apparatus 100 for the SUS pipe 40 according to the present embodiment.

The processing apparatus 100 includes a heater unit 101, a power source 102, an inert gas supply unit 103, a moisture detecting device 50, and a control unit 104. When applying a process for desorbing moisture in the SUS pipe 40, the SUS pipe 40 is placed in the heater unit 101, and a certain amount of current is supplied to a heater 70 in the heater unit 101 from the power source 102, to heat the SUS pipe 40 for a certain amount of time at a temperature of 300° C. or higher. It is preferable that a heat insulator is provided in the heater unit 101 to prevent heat escaping to an outside.

An inside of the processing apparatus 100 may be an atmospheric environment, or may be a vacuum environment. However, when heating is performed under an atmospheric environment, the SUS pipe 40 may change in quality (for example, the SUS pipe 40 may be oxidized) because the SUS pipe 40 may react with oxygen or because of reaction such as with organic substances. Therefore, in order to prevent a surface of the SUS pipe 40 from changing in state, it is preferable that the SUS pipe 40 is heated by the heater 70 while introducing inert gas such as Ar gas or $N_2$ gas, or while the inside of the processing apparatus 100 is maintained in a vacuum environment.

Thus, from the inert gas supply unit 103, an inert gas such as Ar gas having moisture concentration of 0.2 ppb or less is supplied to the processing apparatus 100.

The moisture detecting device 50 measures moisture concentration of an inert gas flowing out of the gas outlet (OUT) of the SUS pipe 40. The moisture concentration (unit of the moisture concentration is ppb) measured by the moisture detecting device 50 represents an amount of moisture per unit volume desorbed from the SUS pipe 40. The moisture detecting device 50 may also measure moisture concentration of an inert gas flowing into the gas inlet (IN) of the SUS pipe 40, in addition to the moisture concentration of an inert gas flowing out from the gas outlet (OUT) of the SUS pipe 40.

The control unit 104 acquires the moisture concentration of an inert gas flowing out of the gas outlet (OUT) measured by the moisture detecting device 50. That is, the control unit 104 acquires concentration of moisture desorbed from the SUS pipe 40. The control unit 104 controls heating temperature and a heating time of the heater 70, by controlling the power source 102 in accordance with the obtained moisture concentration. Note that the control unit 104 includes a CPU (Central Processing Unit) and a memory device such as a ROM (Read Only Memory) or a RAM (Random Access Memory), which are not illustrated. Temperature of the heater 70 is controlled by the CPU executing a program stored in the memory device.

Note that the heater unit 101 is an example of a heating means (heating unit) for heating a stainless steel part with a heating member that is controlled to be at 300° C. or higher, and the heater 70 is an example of the heating member that is controlled to be at 300° C. or higher.

The moisture detecting device 50 is an example of a moisture detecting means (moisture detecting unit) for detecting concentration of moisture desorbed from a stainless steel part. When a certain time has elapsed after heating of a stainless steel part by the heating means was started, the control unit 104 detects that moisture concentration has reached a peak. The control unit 104 is an example of a control means for controlling the heating means such that the stainless steel part is heated at 300° C. or higher until moisture concentration detected after detecting the peak becomes not higher than one hundredth of the peak.

Figure 8:
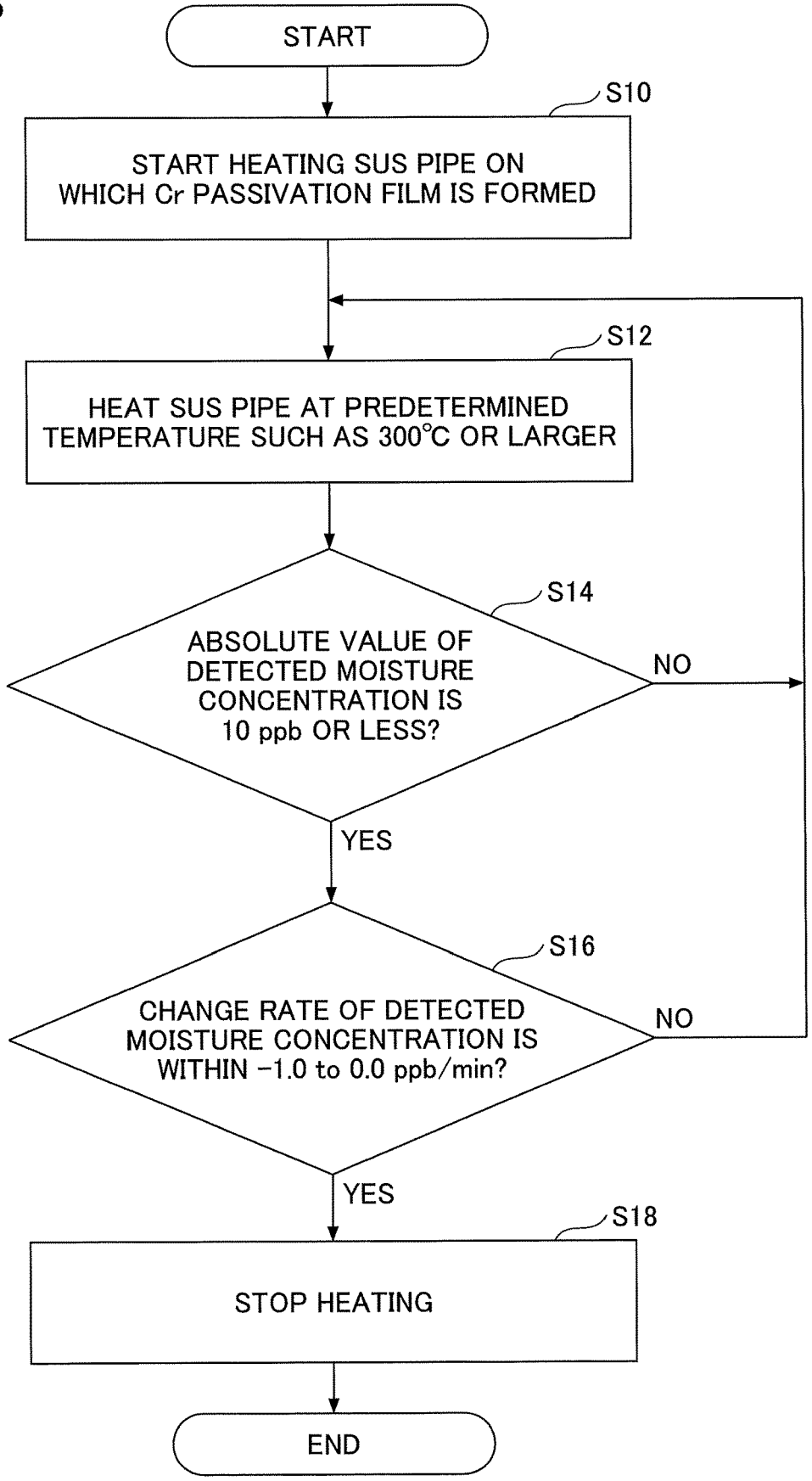
FIG. 8 is a flowchart illustrating an example of a manufacturing method of the pipe according to the embodiment including a processing method of the pipe.

Next, a method of processing the SUS pipe 40 by the control unit 104 of the processing apparatus 100 according to the present embodiment, and a manufacturing method of the SUS pipe 40 including the method of processing will be described with reference to FIG. 8. FIG. 8 is a flowchart illustrating an example of the method of processing the SUS pipe 40 by the control unit 104 of the processing apparatus 100 and the manufacturing method of the SUS pipe 40 including the method of processing.

Before a process illustrated in the flowchart of FIG. 8 is started, the SUS pipe 40 having the Cr passivation film 40*b* on a surface of the SUS pipe 40 is placed in an atmospheric environment at about 25° C. Further, from the inert gas supply unit 103, the inert gas such as Ar gas having moisture concentration of 1 ppb or less is supplied to the inside of the SUS pipe 40.

Note that moisture concentration (or an amount of moisture) of an inert gas flowing out from the gas outlet (OUT) of the SUS pipe 40, by the moisture detecting device 50, is measured. The control unit 104 periodically acquires the measured moisture concentration (or an amount of moisture) from the moisture detecting device 50.

When the process is started, the control unit 104 starts heating the SUS pipe 40, by controlling the power source 102 to control heating temperature (step S10). Next, the control unit 104 continues heating the SUS pipe 40 at a predetermined temperature of 300° C. or higher, such as 420° C. (step S12). Subsequently, the control unit 104 determines whether or not the detected moisture concentration is 10 ppb or less (step S14). The control unit 104 continues heating the SUS pipe 40 until the moisture concentration detected by the moisture detecting device 50 becomes 10 ppb or less, by repeating steps S12 and S14.

If the control unit 104 determines that the detected moisture concentration is 10 ppb or less, the control unit 104 determines whether or not a change rate of the detected moisture concentration is within a range of −1.0 to 0.0 ppb/min (step S16).

If the control unit 104 determines that the change rate of the detected moisture concentration is not within a range of −1.0 to 0.0 ppb/min, the control unit 104 determines that the heating of the SUS pipe 40 should not be terminated. Accordingly, the process reverts to step S12, and heating of the SUS pipe 40 is continued. Conversely, if the control unit 104 determines that the change rate of the detected moisture concentration is within a range of −1.0 to 0.0 ppb/min, the control unit 104 determines that the heating of the SUS pipe 40 can be terminated. In this case, the control unit 104 stops heating the SUS pipe 40 (step S18), and the process terminates.

According to the above described method (the above described method may also be referred to as an "evaluation method"), an amount of moisture remaining in the SUS pipe 40 according to the present embodiment can be evaluated, in accordance with the detected moisture concentration and the change rate of the moisture concentration. Accordingly, stainless steel parts from which not only physically adsorbed moisture but also chemically adsorbed moisture in the Cr passivation film 40*b* are desorbed can be manufactured.

In the method of processing the SUS pipe 40 according to the present embodiment, whether or not heating of the SUS pipe 40 can be terminated is determined based on the detected moisture concentration. Thus, a time to stop heating the SUS pipe 40 is controlled in real time. Accordingly, in addition to removal of physically adsorbed moisture on the SUS pipe 40, removal of chemically adsorbed moisture in the Cr passivation film 40*b* formed on an innermost surface of the SUS pipe 40 can be attained. Therefore, according to the above described method of processing the SUS pipe 40, corrosion of stainless steel can be suppressed. Note that, in the present disclosure, timing when heating of the SUS pipe 40 can be terminated is referred to as an "end point of a heating process (of the SUS pipe 40)".

Figure 9:
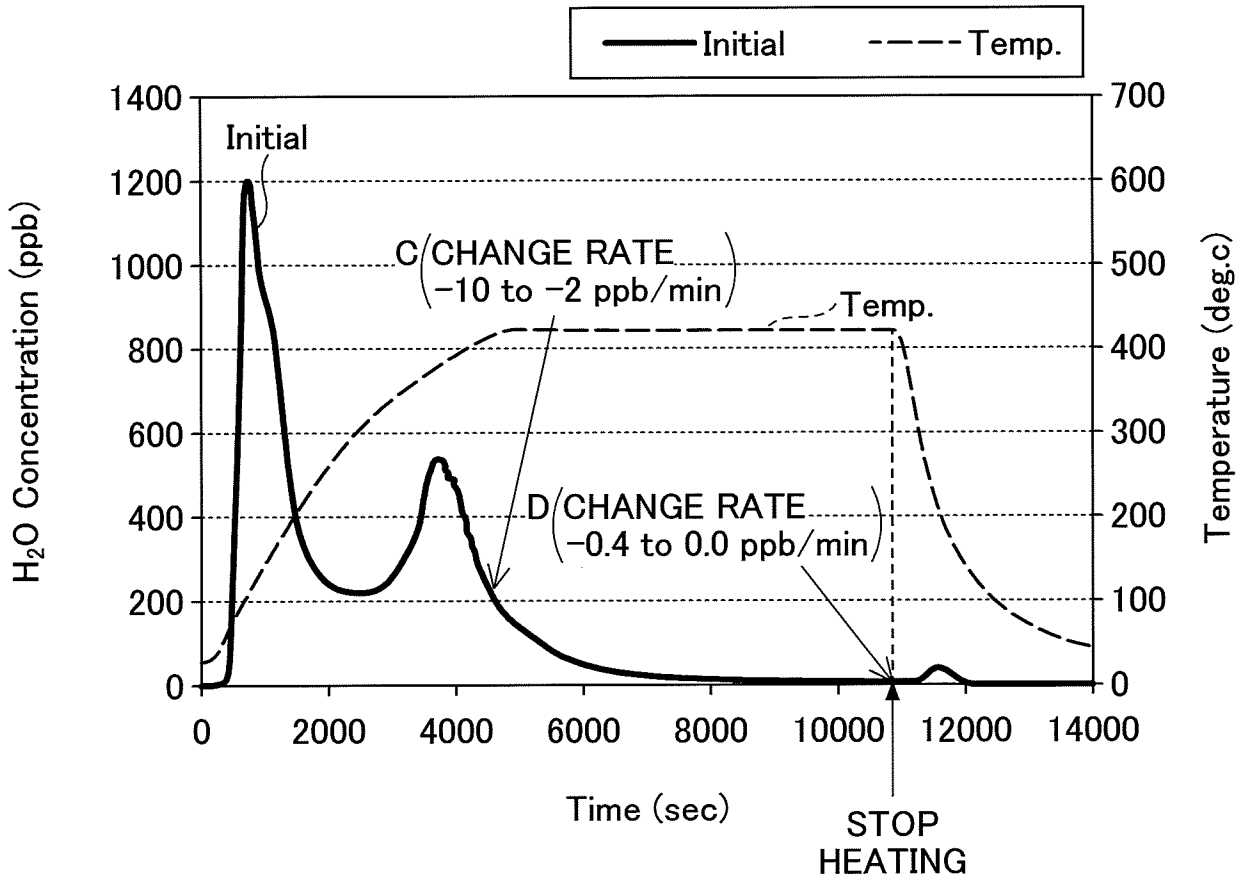
FIG. 9 is a graph illustrating an example of a method of determining an end point of a heating process of the pipe according to the embodiment.

An example of a method of determining an end point of a heating process of the SUS pipe 40 will be described with reference to a graph in FIG. 9. FIG. 9 is a graph illustrating a relationship between concentration of moisture desorbed from the SUS pipe 40 and heating temperature of the SUS pipe 40 when heating the SUS pipe 40 to 420° C. A horizontal axis in FIG. 9 represents a time for heating the SUS pipe 40, a left vertical axis represents concentration of moisture desorbed from the SUS pipe 40, and a right vertical axis represents temperature of the SUS pipe 40. A solid line in FIG. 9 represents a variation of the concentration of moisture desorbed from the SUS pipe (the concentration of moisture desorbed from the SUS pipe 40 may also be referred to as a "desorbed amount of moisture"), and a broken line in FIG. 9 represents temperature of the SUS pipe 40. The heating process of the SUS pipe 40 is performed under a condition in which Ar gas having moisture concentration of 1 ppb or less is supplied from the inert gas supply unit 103 to the SUS pipe 40 at a rate of 1000 sccm.

According to the present embodiment, an end point of the heating process of the SUS pipe 40 is determined based on magnitude of moisture concentration and a change rate of the moisture concentration. For example, at a time of a point C in FIG. 9, magnitude of the detected moisture concentration is not 10 ppb or less. Also, at the time of the point C, the change rate of the detected moisture concentration is in a range between −10 and −2 ppb/min (that is, which is out of a range between −1.0 and 0.0 ppb/min). Therefore, in this case, the control unit 104 determines that the end point of the heating process of the SUS pipe 40 has not been confirmed, and continues heating the SUS pipe 40.

On the other hand, at a time of a point D in FIG. 9, magnitude of the detected moisture concentration (desorbed amount of moisture) is less than 10 ppb, and the change rate of the detected moisture concentration is in a range between −0.4 and 0.0 ppb/min (that is, which is within a range between −1.0 and 0.0 ppb/min). Therefore, in this case, the control unit 104 determines that the end point of the heating process of the SUS pipe 40 has been confirmed, and stops heating the SUS pipe 40.

In the present embodiment, an end point of the heating process is determined in real time. However, a determining method of an end point of the heating process is not limited to the above described method. For example, with respect to SUS pipes 40 having the same composition and being manufactured through the same steps, a heating time of each of the SUS pipes 40 required for removing chemically adsorbed moisture from the Cr passivation film 40*b* is considered to be substantially the same. Thus, after an end point (heating period) of the heating process is determined with respect to a first SUS pipe 40 by performing the above described method (such as the processing in FIG. 8), if other SUS pipes 40, having the same composition and being manufactured through the same steps as the first SUS pipe 40, are to be processed, the other SUS pipes 40 may be heated for a time equal to the determined heating period. After the other SUS pipes 40 have been heated for the time equal to the determined heating period, the control unit 104 may stop heating the other SUS pipes 40.

Further, in the present embodiment, an end point of the heating process is determined based on moisture concentration detected at the gas outlet (OUT) of the SUS pipe 40 by the moisture detecting device 50. However, moisture concentration used for determining an end point of the heating process is not limited to this. For example, in a case in which concentration of moisture contained in Ar gas to be supplied to the SUS pipe 40 is higher than a predetermined value, the control unit 104 may preferably determine an end point of the heating process, based on a difference obtained by subtracting the concentration of the moisture contained in the Ar gas to be supplied to the SUS pipe 40, from the moisture concentration detected by the moisture detecting device 50.

Further, in the present embodiment, the control unit 104 determines whether or not detected moisture concentration is 10 ppb or less, at step S14 in FIG. 8, but the detected moisture concentration may be compared with a value other than 10 ppb. However, the detected moisture concentration needs to be, at most, 100 ppb or less.

Further, in the present embodiment, the control unit 104 determines whether or not a change rate of detected moisture concentration is within a range of −1.0 to 0.0 ppb/min, at step S16 in FIG. 8, but a range of a change rate of detected moisture concentration is not limited to the above example. For example, the control unit 104 may determine that the heating of the SUS pipe 40 can be terminated, in a case in which a change rate of detected moisture concentration is within a range of −0.5 to 0.0 ppb/min.

Further, in the present embodiment, the control unit 104 determines that the heating of the SUS pipe 40 can be terminated if conditions at step S14 and step S16 are satisfied, but a condition to be satisfied at the processing in FIG. 8 is not limited to the above example. For example, the control unit 104 may determine that the heating of the SUS pipe 40 can be terminated if only the condition at step S14 is satisfied. Alternatively, the control unit 104 may determine that the heating of the SUS pipe 40 can be terminated if only the condition at step S16 is satisfied.

[Effect]

Figure 10:
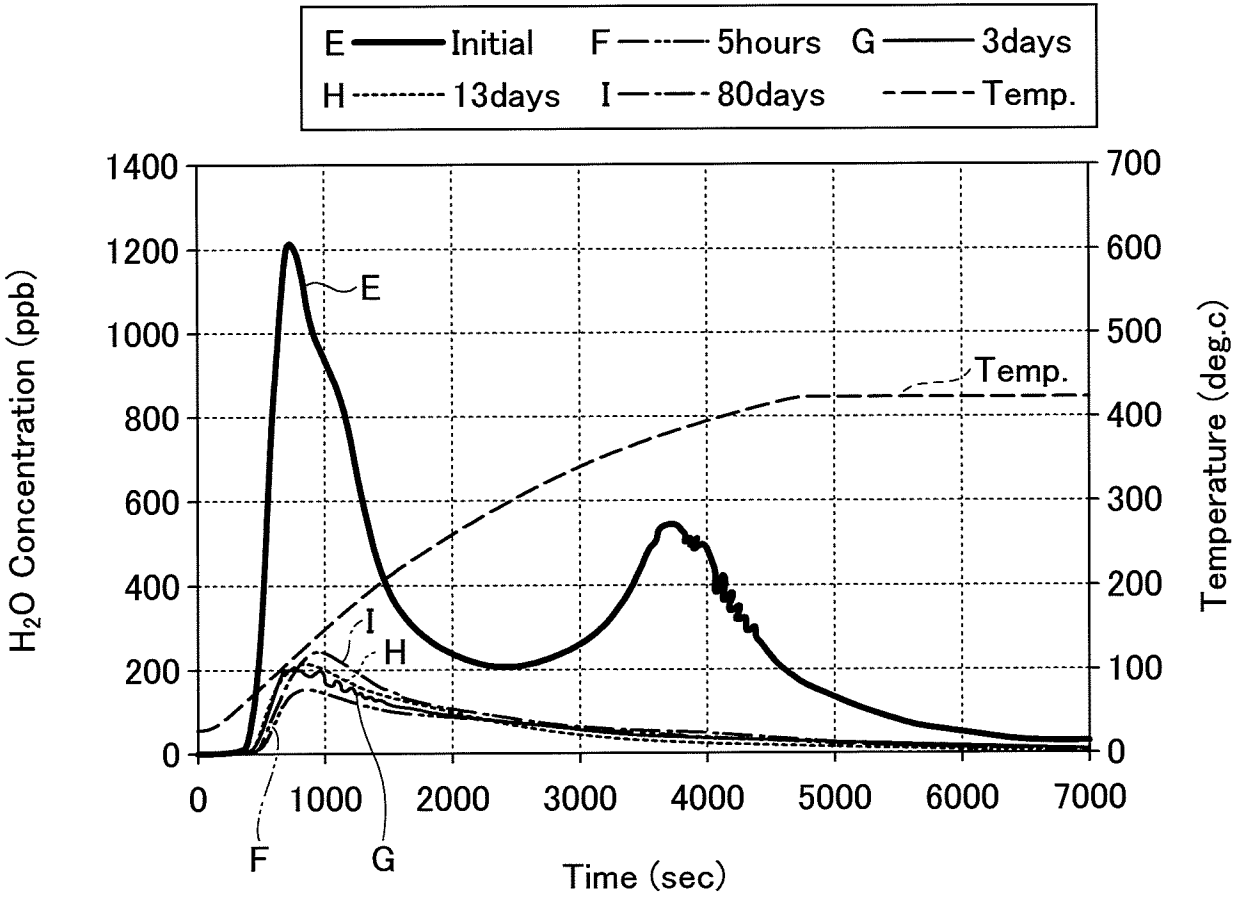
FIG. 10 is a graph illustrating an example of moisture concentration desorbed from the pipe according to the embodiment.

An example of an effect of the SUS pipe 40 manufactured by the above described manufacturing method of the SUS pipe 40, which includes the method of processing the SUS pipe 40 including a step of heating the SUS pipe 40 (may also be referred to as a heating step), will be described with reference to FIG. 10. FIG. 10 is a graph illustrating an example of moisture concentration desorbed from the SUS pipe 40 manufactured by employing the manufacturing method (or processing method) according to the present embodiment.

Here, duration of the effect of the SUS pipe 40, which was manufactured by the manufacturing method including the processing method illustrated in FIG. 8 performed by the processing apparatus 100 in FIG. 7, and which was heated at 420° C. in the heating step, was examined. An example of a result of the examination is illustrated in FIG. 10. In the examination, the SUS pipes 40, all of which had been heated at 420° C. for three hours in the heating step, and which were respectively left in an atmospheric environment (25° C., RH (relative humidity)=45%) for 5 hours, 3 days, 13 days, and 80 days, were prepared. FIG. 10 illustrates an example of a result in which these SUS pipes 40 were heated at 420° C. again and in which concentration of moisture desorbed from the SUS pipes 40 was measured.

A horizontal axis in FIG. 10 represents a time for heating the SUS pipe 40, a left vertical axis represents concentration of moisture desorbed from the SUS pipe 40, and a right vertical axis represents temperature of the SUS pipe 40. A curve E represents concentration of moisture desorbed from an SUS pipe 40 during execution of the heating step in the above mentioned manufacturing method, by heating at 420° C. for three hours. A curve F represents concentration of moisture desorbed from the SUS pipe 40 which was manufactured by the manufacturing method according to the present embodiment, which was heated at 420° C. for three hours in the heating step of the manufacturing method, and which was left for 5 hours in an atmospheric environment, and the concentration of the desorbed moisture was measured by heating the SUS pipe 40 again at 420° C. Similarly, a curve G represents concentration of moisture desorbed from the SUS pipe 40 which was manufactured by the manufacturing method according to the present embodiment, which was heated at 420° C. for three hours in the heating step of the manufacturing method, and which was left for 3 days in an atmospheric environment, and the concentration of the desorbed moisture was measured by heating the SUS pipe 40 again at 420° C. A curve H represents concentration of moisture desorbed from the SUS pipe 40 which was manufactured by the manufacturing method according to the present embodiment, which was heated at 420° C. for three hours in the heating step of the manufacturing method, and which was left for 13 days in an atmospheric environment, and the concentration of the desorbed moisture was measured by heating the SUS pipe 40 again at 420° C. A curve I represents concentration of moisture desorbed from the SUS pipe 40 which was manufactured by the manufacturing method according to the present embodiment, which was heated at 420° C. for three hours in the heating step of the manufacturing method, and which was left for 80 days in an atmospheric environment, and the concentration of the desorbed moisture was measured by heating the SUS pipe 40 again at 420° C. A broken line (Temp.) represents temperature of the SUS pipe 40.

According to the above described result, moisture does not easily adhere to the SUS pipe 40 from which not only physically adsorbed moisture but also chemically adsorbed moisture has been removed by heating the SUS pipe 40 once at 420° C. during execution of the processing method according to the present embodiment. Further, a second peak (which is described with reference to FIG. 4) representing presence of chemically adsorbed moisture is not seen on the curves F, G, H, and I. As a time for which the SUS pipe 40 is left in an atmospheric environment becomes longer, a slight increase in an amount of moisture (or moisture concentration) desorbed from the SUS pipe 40 can be seen. Based on the fact, it is considered that physically adsorbed moisture adheres to the SUS pipe 40 again over time. Thus, although indefinite use is not implied, the SUS pipe 40 manufactured by employing the processing method according to the present embodiment can be used for about one to three months without issue.

Further, in a case in which the SUS pipe 40 is preserved with air removed and with a desiccant enclosed, or in a case in which the SUS pipe 40 is preserved with dry gas not including moisture, a usable period can be extended. Also, as the heat resistant temperature of a joint is approximately 450° C., the heating step of heating the SUS pipe 40 at not higher than 450° C., such as at 420° C., does not cause an adverse effect to a vacuum characteristic, a leak characteristic, or a size of the SUS pipe 40.

[Variations]

(Variation 1)

Figure 11A:
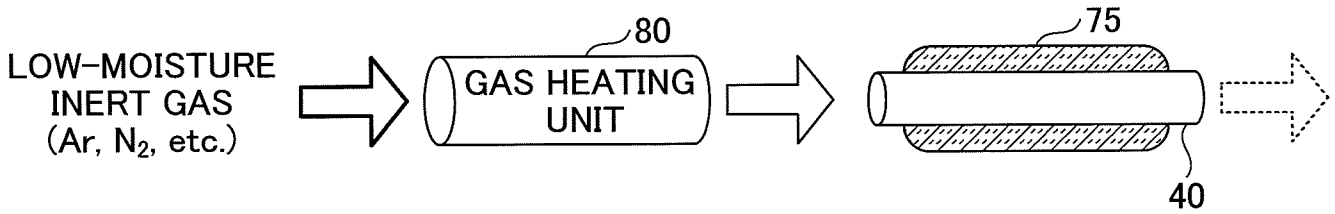
FIGS. 11A to 11C are diagrams illustrating examples of pipes.

The processing apparatus 100 according to the above described embodiment heats the SUS pipe 40 and an inert gas flowing inside the SUS pipe 40, by surrounding the SUS pipe 40 by the heater 70, but a heating means is not limited to the above described heater 70. An example of another heating means (a heating means according to a variation 1) is illustrated in FIG. 11A. That is, the SUS pipe 40 may be covered with a heat insulator 75, an inert gas having low humidity may be heated at a temperature of 300° C. or higher by using a gas heating unit 80, and the heated gas may be supplied to the inside of the SUS pipe 40. By using the heating means according to the variation 1, the SUS pipe 40 can be heated to 300° C. or higher.

In one embodiment, the Cr passivation film 40*b* is a film having a thickness of several nanometers formed on an innermost surface of the SUS pipe 40. Physically adsorbed moisture adheres to a surface of the SUS pipe 40. Chemically adsorbed moisture exists in a region from a surface of the Cr passivation film 40*b* to a depth of several nanometers. If the region is heated to 300° C. or higher, physically adsorbed moisture and chemically adsorbed moisture can be desorbed from the SUS pipe 40. In another embodiment, the Cr passivation film 40*b* is a film having a thickness of 20 to 35 nanometers. By forming the Cr passivation film 40*b* thicker, the SUS pipe 40 can be protected from corrosive gas even if damage or abrasion occurs on a part of the Cr passivation film 40*b*.

As a means for heating the region, gas at 300° C. or higher may be supplied in the SUS pipe 40, to heat the SUS pipe 40 from an inside (a surface contacting with gas) of the SUS pipe 40.

The means for heating gas to 300° C. or higher and supplying the heated gas in the SUS pipe 40 is an example of a heating means for heating a stainless steel part having the Cr passivation film 40*b* on a surface of the stainless steel part. The heating means according to the variation 1 can heat a wide range of the SUS pipe 40 regardless of a shape of the SUS pipe 40. For example, a pipe with which a joint or a valve is connected, or a pipe having a complex shape can be uniformly heated by the heating means according to the variation 1.

Figure 11B:
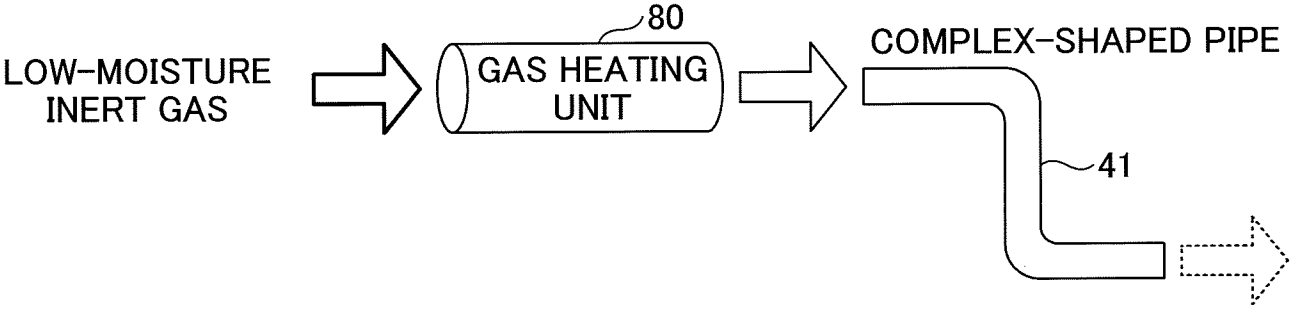
Figure 11C:
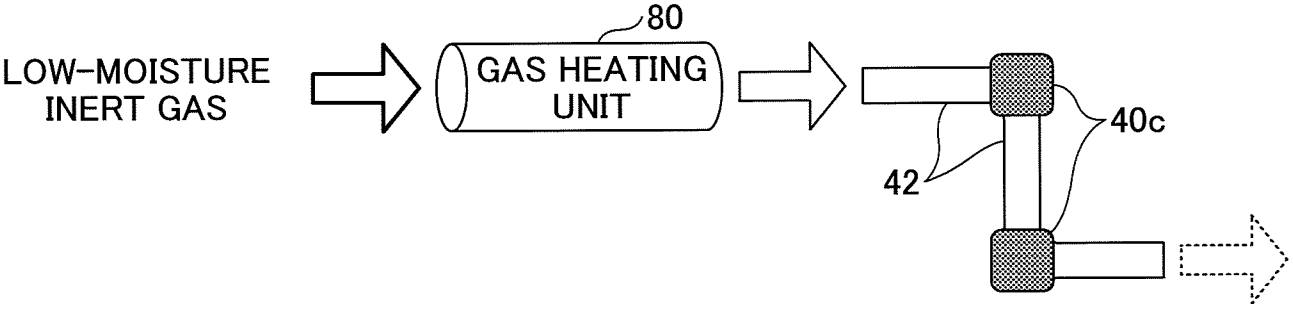

As illustrated in FIG. 11B or FIG. 11C, the SUS pipe 40 having a complex shape to which bending or welding is applied, and the SUS pipe 40 with which a joint is provided, may be heated with gas having temperature of 300° C. or higher, because the entirety of the SUS pipe 40 can be heated easily. For example, an inert gas of low moisture may be supplied to the gas heating unit 80 in order to generate gas having temperature of 300° C. or higher, and the generated gas may be supplied to the SUS pipe 40. A range to be heated can be controlled by selecting an appropriate gas heating unit 80 among gas heating units 80 having different specifications (heating capacity). Although temperature of the heated gas decreases as the heated gas passes through the SUS pipe 40, by increasing a flow rate of the heated gas to be supplied to the SUS pipe 40, a longer pipe can be heated appropriately.

According to the heating means of the variation 1, the SUS pipe 40 having been already installed to a predetermined location can be heated. Note that a pressure in the SUS pipe 40 while being heated is not limited to a specific value. Also, when the heating process of the SUS pipe 40 is completed, the SUS pipe 40 may be exposed to an atmosphere or oxygen after temperature of the SUS pipe 40 decreases.

(Variation 2)

Heating temperature of the heater 70 controlled by the control unit 104 or heating temperature of an inert gas is not limited to 300° C., and may be 320° C. or higher. It is preferable that the control unit 104 controls heating of the SUS pipe 40 such that temperature of the SUS pipe 40 is within a range between 380° C. and 450° C., because chemically adsorbed moisture can be removed almost completely.

(Variation 3)

When conditions, such as heating temperature of the SUS pipe 40, an amount of moisture contained in Ar gas supplied to the SUS pipe 40, and a flow rate of Ar gas, are constant, an amount of moisture desorbed from the SUS pipe 40 is approximately in proportion to an amount of moisture remaining on a surface of the SUS pipe 40.

Figure 12A:
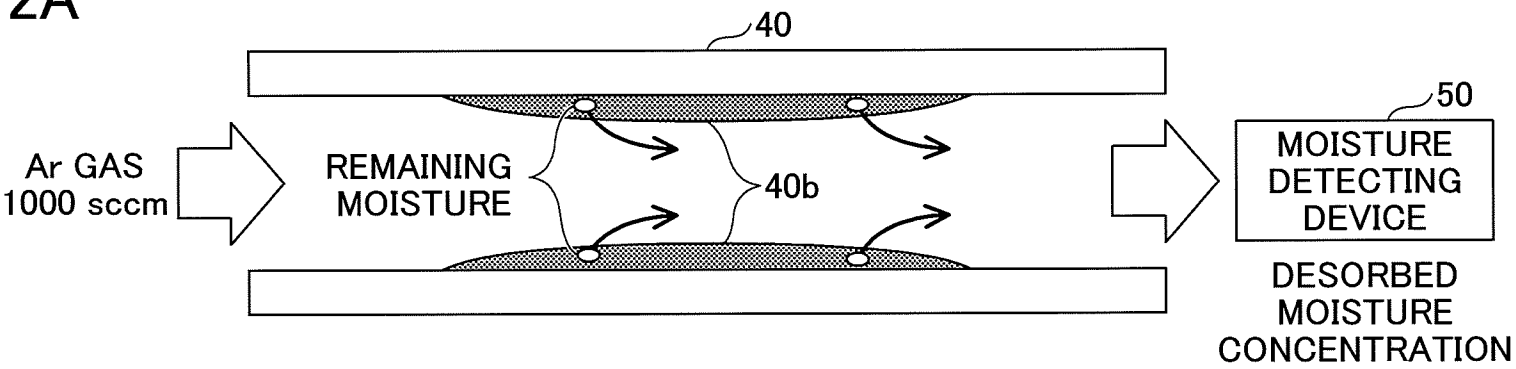
FIG. 12A and FIG. 12B are diagrams illustrating an example of a relationship between an amount of remaining moisture and concentration of desorbed moisture.
Figure 12B:
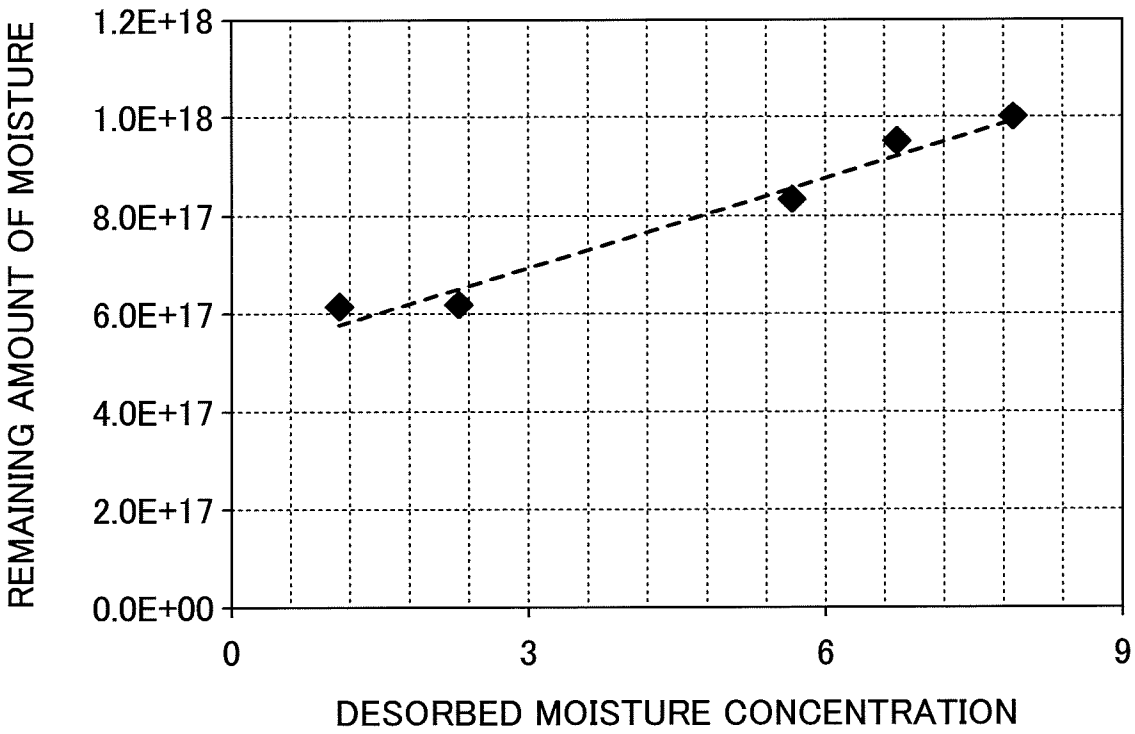

For example, FIG. 12A illustrates a case in which Ar gas having moisture concentration of 1 ppb or less is supplied in the SUS pipe 40, while controlling a flow rate of the Ar gas to be 1000 sccm. Note that the SUS pipe 40 is heated at 420° C. The moisture detecting device 50 detects an amount of desorbed moisture per unit time (concentration of desorbed moisture) which is contained in the gas flowing out of the SUS pipe 40.

In this case, as illustrated in a graph in FIG. 123, moisture concentration detected by the moisture detecting device 50 (concentration of desorbed moisture) is in proportion to an amount of moisture remaining on the surface of the SUS pipe 40, mainly in the Cr passivation film 40*b*.

Thus, instead of performing the method of determining an end point of the heating process according to the above described embodiment, the control unit 104 may perform a determination of an end point of the heating process to be described below. That is, the control unit 104 may control a length of time for heating the SUS pipe 40 (or may control a time of stopping heating of the SUS pipe 40) in accordance with a difference between moisture concentration in an inert gas detected at a gas inlet (IN) of the SUS pipe 40 and moisture concentration in an inert gas detected at a gas outlet (OUT) of the SUS pipe 40.

That is, the control unit 104 may determine an end point of the heating process based on a value of moisture concentration detected by the moisture detecting device 50. Alternatively, the control unit 104 may cause the moisture detecting device 50 to detect moisture concentration in a gas flowing into the SUS pipe 40 and moisture concentration in a gas flowing out of the SUS pipe 40, and may determine an end point of the heating process based on a difference between a value of the moisture concentration in a gas flowing into the SUS pipe 40 and a value of the moisture concentration in a gas flowing out of the SUS pipe 40.

For example, the control unit 104 calculates a difference between moisture concentration in an inert gas, flowing into the SUS pipe 40, which is detected at the gas inlet and moisture concentration in an inert gas, flowing out of the SUS pipe 40, which is detected at the gas outlet. The control unit 104 may control the processing apparatus 100 such that the SUS pipe 40 is heated at a predetermined temperature not less than 300° C., until the calculated difference becomes less than 100 ppb. It is more preferable that the control unit 104 controls the processing apparatus 100 such that the SUS pipe 40 is heated at a predetermined temperature not less than 300° C., until the calculated difference becomes less than 10 ppb.

By detecting moisture concentration at an inlet of the SUS pipe 40 and an outlet of the SUS pipe 40, concentration of moisture desorbed from the inside of the SUS pipe 40 can be detected in real time. Accordingly, a length of time for heating the SUS pipe 40 can be appropriately controlled, in accordance with a result of the detection.

However, moisture concentration at which the heating process can be terminated may vary, depending on a flow rate of introduced gas (a length of time when the introduced gas remains in the SUS pipe 40). Thus, moisture concentration at which the heating process can be terminated needs to be determined, for each condition of the heating process.

(Variation 4)

In the above described embodiment, a processing method of a stainless steel part, a manufacturing method of a stainless steel part including the processing method of a stainless steel part, and the processing apparatus 100 for manufacturing a stainless steel part by using the processing method and the manufacturing method has been described, by taking the SUS pipe 40 for an example of a stainless steel part to be processed by the processing or manufacturing method according to the present invention. The SUS pipe 40 is an example of a stainless steel part on which a Cr passivation film is formed. The stainless steel part is an example of a metal member on which a passivation film is formed. The stainless steel part is an example of a part (component) of the substrate processing apparatus 1. The passivation film is not limited to a Cr passivation film. For example, metal oxide, such as $TiO_2$, $Al_2O_3$, and $Y_2O_3$, may be formed on a surface of a metal member, as a passivation film.

For example, the stainless steel part may be part other than a pipe, such as a joint or a screw. In this case, the part formed of stainless steel is stored in the processing apparatus 100, and the part may be heated, while an inert gas is introduced into the processing apparatus 100, at a temperature of 300° C. or higher, preferably at a temperature of 380° C. to 450° C. Alternatively, after the part formed of stainless steel is stored in the processing apparatus 100, the part may be heated by introducing, into the processing apparatus 100, an inert gas at a temperature of 300° C. or higher, preferably at a temperature of 380° C. to 450C.

(Variation 5)

In a heating step according to a variation 5, after a stainless steel part is heated to 300° C. or higher, a step of detecting a peak of concentration of moisture desorbed from the stainless steel part is performed. In the variation 5, until moisture concentration that is detected after the peak has been detected becomes one hundredth of the peak or less, the stainless steel part may be heated at 300° C. or higher.

As described above, a processing method of the SUS pipe 40 and a processing apparatus for the SUS pipe 40 according to the above described embodiment and its variations can remove chemically adsorbed moisture contained in a passivation film formed on an innermost surface of the SUS pipe 40. Further, even if the SUS pipe 40 from which the chemically adsorbed moisture is removed is placed in an atmospheric environment, moisture does not easily adhere to the SUS pipe 40 again. Thus, corrosion of the SUS pipe 40 can be suppressed. As a result, in the substrate processing apparatus 1 in which the SUS pipe 40 is provided, occurrence of metallic contamination by Cr, Fe, Ni, or the like, or occurrence of particle contamination, caused by corrosion of the SUS pipe 40, can be prevented.

Further, by heating the SUS pipe 40 at 300° C. or higher, not only moisture but also a contamination source such as an organic substance can be removed. For example, even if degreasing and cleaning of the SUS pipe 40 is performed, in a case in which cleaning is insufficient and a residue is remaining on the SUS pipe 40, organic contamination may occur in an apparatus in which the SUS pipe 40 is installed. However, in the processing method and the processing apparatus for the SUS pipe 40 according to the above described embodiment and its variations, because the manufacturing method of the SUS pipe 40 including the above described heating step is performed, not only moisture but also organic matter can be removed almost perfectly.

Further, by heating the SUS pipe 40 at 300° C. or higher, a thickness of the Cr passivation film 40*b* can be made to be uniform, or the thickness can be increased. That is, a more durable Cr passivation film 40*b* may be formed. A thickness of the Cr passivation film 40*b* is, but not limited to, approximately 5 nm, for example. Thus, if a surface of the main part 40*a* of Fe is roughened, the Cr passivation film 40*b* may not be formed sufficiently on a surface of the main part 40*a*, and a part of the main part 40*a* of Fe may be exposed to a surface of the SUS pipe 40. However, if the SUS pipe 40 is heated at 300° C. or higher, a surface of the Cr passivation film 40*b* is made to be smooth and strong, forming of the Cr passivation film 40*b* is promoted, and the Cr passivation film 40*b* can be made to be uniform. Accordingly, corrosion of the SUS pipe 40 can be further avoided.

Although the processing method, the processing apparatus, and an evaluation method of a metal member have been described in the above embodiments, a processing method, a processing apparatus, and an evaluation method of a metal member according to the present invention is not limited to the above embodiments. Various changes or enhancements can be made hereto within the scope of the present invention. Matters described in the above embodiments may be combined unless inconsistency occurs.

What is claimed is:

1. A method of processing metal member having a passivation film on a surface of the metal member, the method comprising:

heating the metal member tear a predetermined period at a temperature of 300° C. or higher; wherein the metal member is formed of stainless steel, and the passivation film on the surface of the metal member is a chromium passivation.

2. The method according to claim 1, wherein in the beating, the metal member is heated at a temperature between 380° C. and 450° C.

3. The method according to claim 1, wherein the heating is performed while supplying an inert gas.

4. The method according to claim 3, wherein the heating, is performed by using a heating member at a temperature of 300° C. or higher.

5. The method according to claim 1, further comprising detecting concentration of moisture desorbed from the metal member; wherein the heating includes controlling a time for stopping the heating of the metal member, in accordance with the detected concentration of moisture, the controlling being performed after the metal member is heated to 300° C. or higher.

6. The method according to claim 5, wherein the heating of the metal member is stopped in response to the detected concentration of moisture becoming 100 ppb or less, after the metal member is heated to 300° C. or higher.

7. The method according to claim 5, wherein the heating of the metal member is stopped, in response to the detected concentration of moisture becoming 100 ppb or less, and a change rate of the detected moisture concentration becoming within a range of −1.0 to 0.0 ppb/min, after the metal member is heated to 300° C. or higher.

8. The method according to claim 5, wherein the heating of the metal member is stopped, in response to a difference, between moisture concentration in an inert gas flowing into the metal member and moisture concentration in the inert gas, flowing out of the metal member, becoming 100 ppb or less.

9. The method according to claim 5, wherein the heating of the metal member is stopped, in response to a difference, between moisture concentration in an inert gas flowing into the metal member and moisture concentration in the inert gas flowing out of the metal member, becoming 10 ppb or less.

10. The method according to claim 1, wherein the metal member is a part of a processing apparatus, the passivation film on the surface of the part being exposed to corrosive gas.

11. A processing apparatus comprising:

a heating unit configured to heat a metal member a moisture detecting unit configured to detect concentration of moisture desorbed from the metal member; and a control unit configured to control, the moisture detecting unit and the heating unit; wherein the control unit is configured to heat the metal member to 300° C. or higher by using the heating unit, the metal member being formed of stainless steel and having a chromium passivation film on a surface of the metal member, detect the concentration of moisture desorbed from the metal member by using the moisture detecting unit, and continue heating the metal member at 300° C. or higher, until the concentration of moisture, detected by the moisture detecting unit, becomes 100 ppb or less, and until a change rate of the detected moisture concentration becomes within a range of −1.0 to 0.0 ppb/min.

12. A processing apparatus comprising:

a heating unit configured to heat a metal member;

a moisture detecting unit configured to detect concentration of moisture desorbed from the metal member; and a control unit configured to control the moisture detecting unit and the heating unit; wherein the control unit is configured to heat the metal member to 300° C. or higher by using the heating unit, the metal member being formed of stainless steel and having a chromium passivation film on a surface of the metal member, detect the concentration of moisture desorhed from the metal member by using the moisture detecting unit, and after detecting that the concentration of moisture has reached a peak, continue heating the metal member at 300° C. or higher until the concentration of moisture that is detected after detecting the peak becomes not higher than one hundredth of the peak.

13. The method according to claim 3, wherein the heating is performed by supplying, to the metal member, the inert gas at a temperature, of 300° C. or higher.

* * * * *